United States Patent [19]

Cinquin et al.

[11] Patent Number: 4,631,508

[45] Date of Patent: Dec. 23, 1986

[54] ELECTRO-MECHANICAL DEVICES INCORPORATING FUSE CARTRIDGES

[75] Inventors: Jean P. Cinquin, Cremieu; Christian Gazzolo, Villeurbanne; Michel Pisciotta, Bron, all of France

[73] Assignee: Ferraz, Lyons, France

[21] Appl. No.: 778,470

[22] Filed: Sep. 20, 1985

[51] Int. Cl.[4] ..... H01H 51/00; H01H 53/00

[52] U.S. Cl. ..... 335/142; 200/151; 335/147

[58] Field of Search ..... 335/142, 147, 6, 195; 337/4, 5; 200/151

[56] References Cited

U.S. PATENT DOCUMENTS 3,128,361 4/1964 Kesselring ..... 200/151

4,292,611 9/1981 Bresson et al. ..... 335/147

*Primary Examiner*—Harold Broome

*Attorney, Agent, or Firm*—Dowell & Dowell

[57] ABSTRACT

An electro-mechanical circuit breaker device incorporating a fuse cartridge, wherein two contact bars are normally connected by a series of mobile contacts held against their lower edge by springs, two in number for each. An insulating plate, suitably guided at its edges in the insulating envelope of the apparatus, receives the downward displacement that a coil applies by the Thomson effect to an aluminum disc, and it lowers the contacts against spring and latches them in open position by engagement of a bolt in a notch. The lower edge of the plate is provided with teeth to receive the successive contacts and retain them transversely, while each of the mobile contacts is notched to ensure lengthwise retention.

8 Claims, 4 Drawing Figures

ELECTRO-MECHANICAL DEVICES INCORPORATING FUSE CARTRIDGES

The present invention relates to electro-mechanical devices which include a fuse cartridge and which are used as switches or circuit breakers. Such an apparatus comprises, in principle, fixed contacts, one or more corresponding mobile contacts, a coil adapted to control displacement of the latter and a fuse cartridge of relatively small calibre, mounted in parallel with the system of contacts. When the coil is energized, it repels by the Thomson effect a mobile conductive disc coupled to the mobile contacts, which are then retained in the open position by engagement of a bolt, pawl or the like. The circuit constituted by the fixed and mobile contacts is thus cut at a low voltage and all the current passes through the cartridge which melts with a delay which is very short but which is sufficient for the contacts to achieve major separation. The break arc is thus established inside the cartridge where it is absorbed by the filling material thereof.

As is known, it has been proposed to mount the mobile contacts on an insulating plate shaped so as to be inserted between the fixed contacts in order to avoid any direct starting of electric arcs therebetween. This insulating plate is fixed to a disc-shaped plate which cooperates with an actuation coil so as to be suddenly displaced by the Thomson effect when said coil is energized. U.S. Pat. No. 3 128 361 to KESSEKRING clearly illustrates such an arrangement.

However, experience has shown that it is difficult effectively to avoid bounce of the mobile insulating plate under the effect of the holding springs which are physically associated therewith, and it is a principal object of the present invention to overcome this drawback.

According to the invention, the insulating contact-holder plate is displaced by the disc-shaped plate without being connected thereto, whilst the stroke of said disc is stopped by a fixed shoulder which allows the plate to pursue its movement as a result of kinetic energy until it is retained in the open position of the mobile contacts by a latch bolt system.

The invention will be more readily understood on reading the following description with reference to the accompanying drawings, in which.

Figure 1:
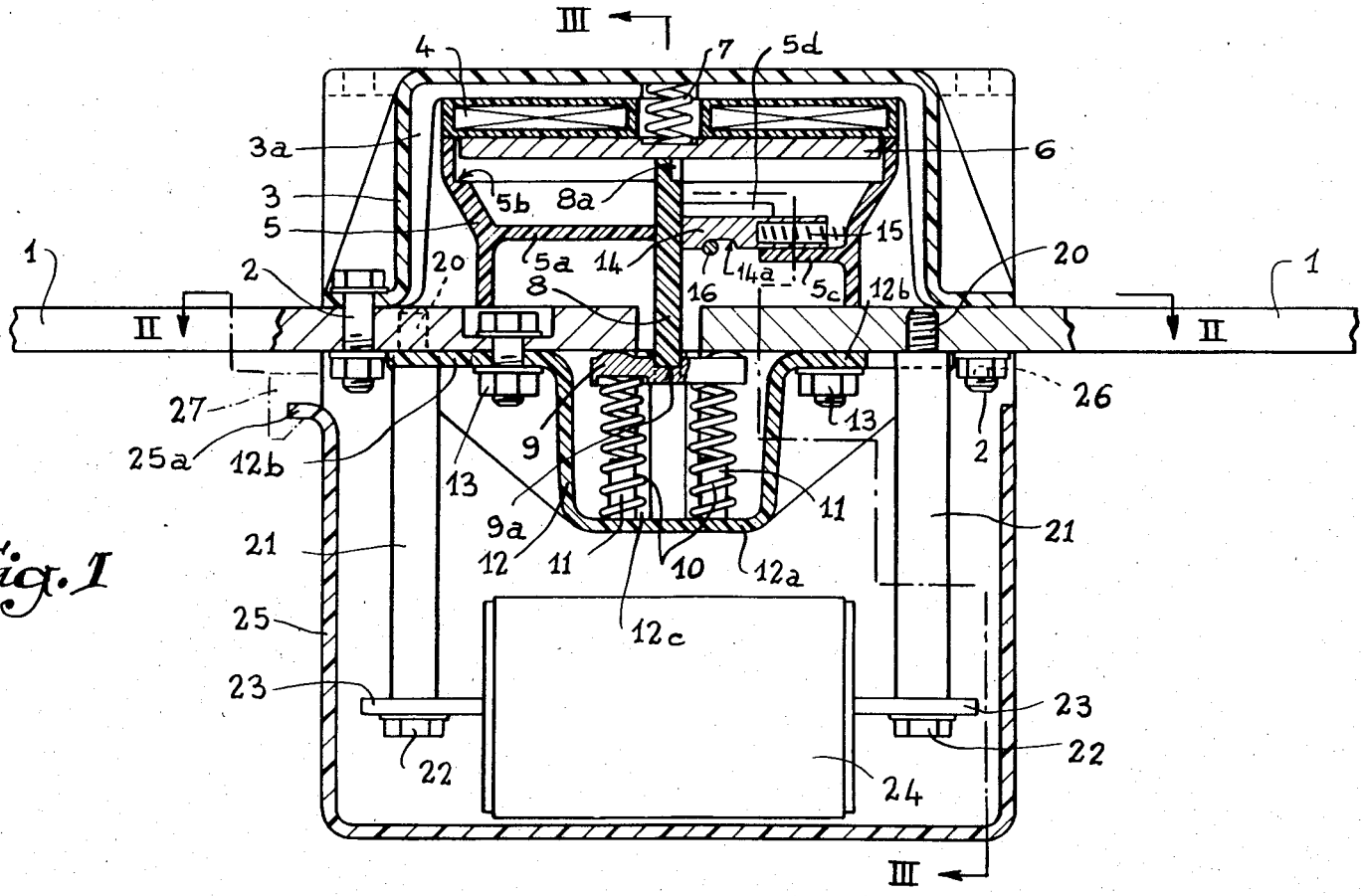
FIG. 1 is a vertical section through an apparatus according to the invention, the mobile contacts being closed.

Referring now to the drawings, the device comprises two fixed contacts constituted by the opposite ends of two bars 1 disposed coaxially with a small separating gap lengthwise. Bolts 2 fix these bars to an upturned upper insulating dish 3. Against the bottom thereof is disposed a flat circular coil 4 which bears against the ribs 3*a* of said bottom. Between the coil 4 and the contact bars 1 is maintained an intermediate portion 5, of generally cylindrical shape, provided with a horizontal partition 5*a*, as will be seen hereinafter. Of course, the coil 4 is suitably coated with insulating material so as to constitute a rigid piece.

Immediately below this coil 1 is disposed a circular mobile disc 6 made of a metal which is a very good conductor and relatively light, such as aluminium. The disc 6 is urged downwardly by a spring 7 which abuts against the bottom of the dish 3, coaxially to the coil 4, but it is retained against the action of this spring by the upper edge of a vertical insulating plate 8 which, passing through the partition 5*a*, passes between the fixed contacts 1 and abuts against a series of mobile contacts 9, which the springs 10 maintain applied against said fixed contacts 1. The lower edge of the plate 8 is provided with a series of notches in which the mobile contacts 9 are engaged and whereby this part of plate 8 somewhat takes the form of a comb. Each contact 9 is itself provided with a notch 9*a* in which is engaged a tooth bottom of this profile, with the result that the contact 9 in question is retained with respect to the plate 8 longitudinally and transversely. On the other hand, there are provided for each contact 9 two springs 10 located on either side of the mean plane of the plate 8, these springs being engaged on centering lugs 11 fixed to the bottom 12*a* of a lower box 12 with rectangular profile in plan, of which the edges 12*b*, disposed horizontally, are fixed to the contact bars 1 by bolts 13.

The reaction of the springs 10 is sufficient to maintain the disc 6 applied with a slight clearance beneath coil 4, despite the presence of the spring 7, the mobile contacts 9 bearing against the fixed contact bars 1 with the desired pressure, notwithstanding the inevitable manufacturing and assembly tolerances.

When the coil 4 has a sufficiently intense current pulse passing therethrough, the mobile disc 6 is repelled downwardly by the Thomson effect against springs 10. It lowers until it abuts against an inner shoulder 5*b* of piece 5, whilst plate 8 continues its descending stroke under the effect of the kinetic energy, moving the mobile contacts 9 away from the fixed contact bars 1, and latching them in lowered position by means of a bolt 14, urged by a spring 15, the end of this bolt engaging in a notch 8*a* in the plate.

Figure 2:
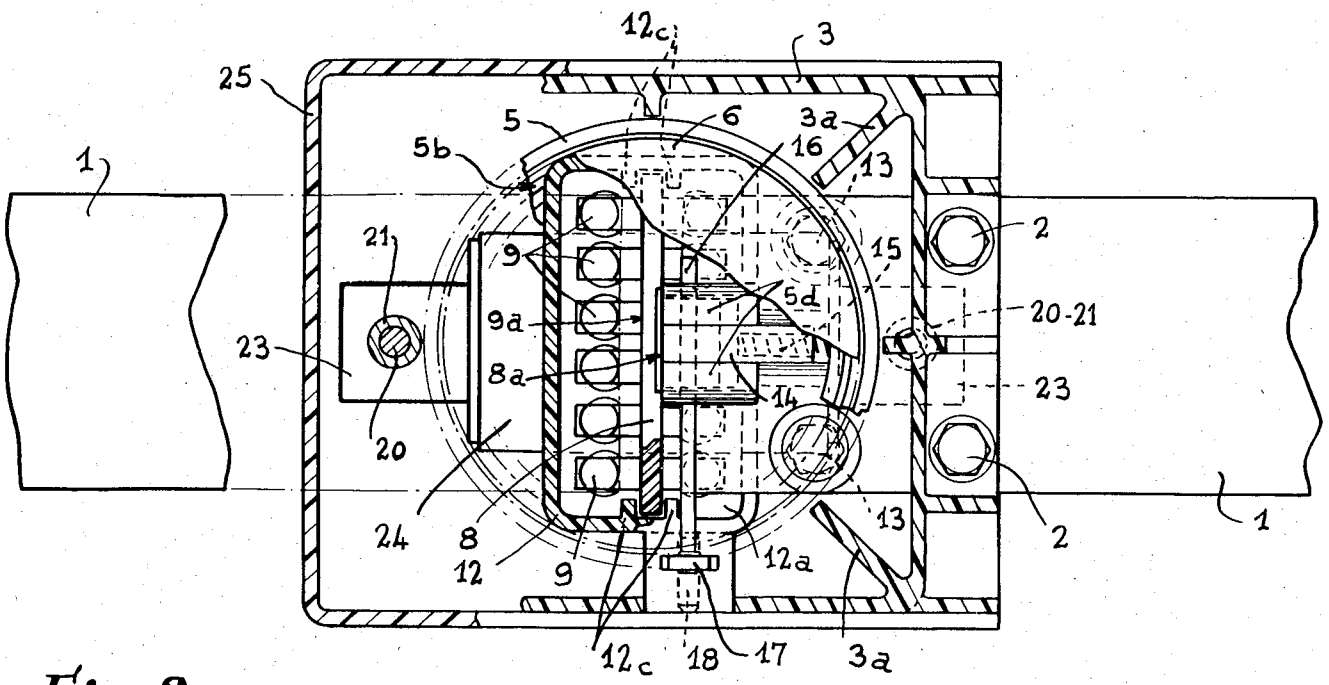
FIG. 2 is a sectional view partly broken away, along II—II (FIG. 1).
Figure 3:
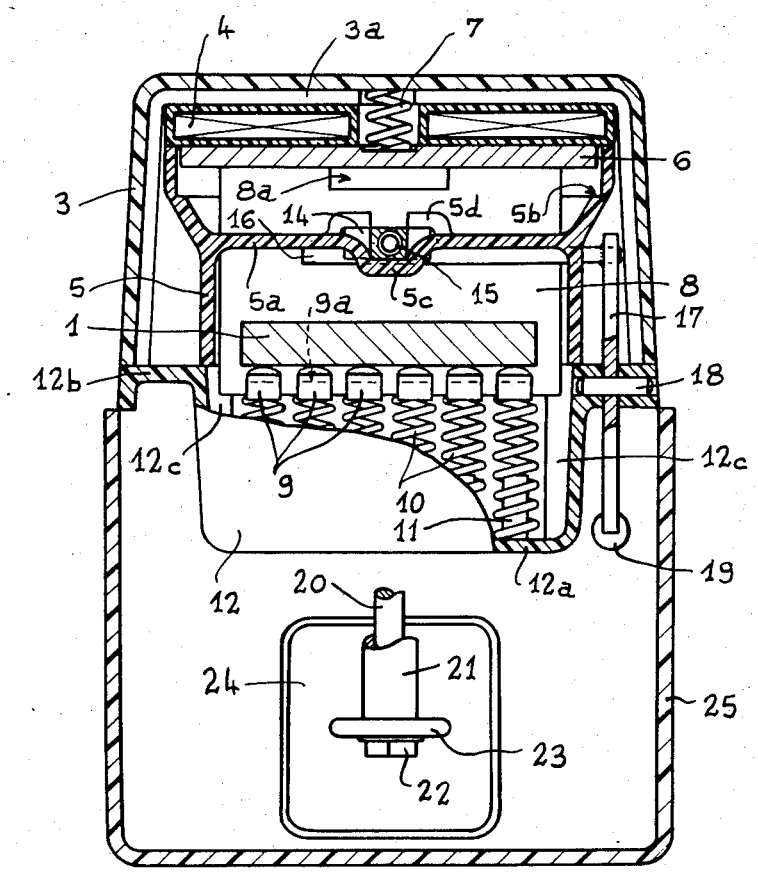
FIG. 3 is a sectional view along III—III (FIG. 1).

Plate 8 is guided in its descending movement on the one hand by partition 5*a* that it passes through with reduced clearance, on the other hand by vertical ribs 12*c* provided inside the box 12 (cf. FIGS. 2 and 3). As for bolt 14, it rests on a lowered part 5*c* of the partition 5*a* (cf. FIG. 3) and may move beneath two edges 5*d* thereof. It comprises on its lower face a notch 14*a* of which the flat bottom bears on a rod 16.

Rod 16 extends parallel to the largest horizontal dimension of the lower box 12 up to the vicinity of the wall of the upper dish 3 and is connected by welding to a control lever 17 mounted to rotate on a pin 18, the lower end of this lever projecting beneath the pin and terminating in a hand knob 19.

Pin 18 is driven in a lateral boss in the lower box 12 which is suitably notched to allow passage of the lever 17 as well as the slight angular clearance necessary for operation (FIGS. 2 and 3).

Figure 4:
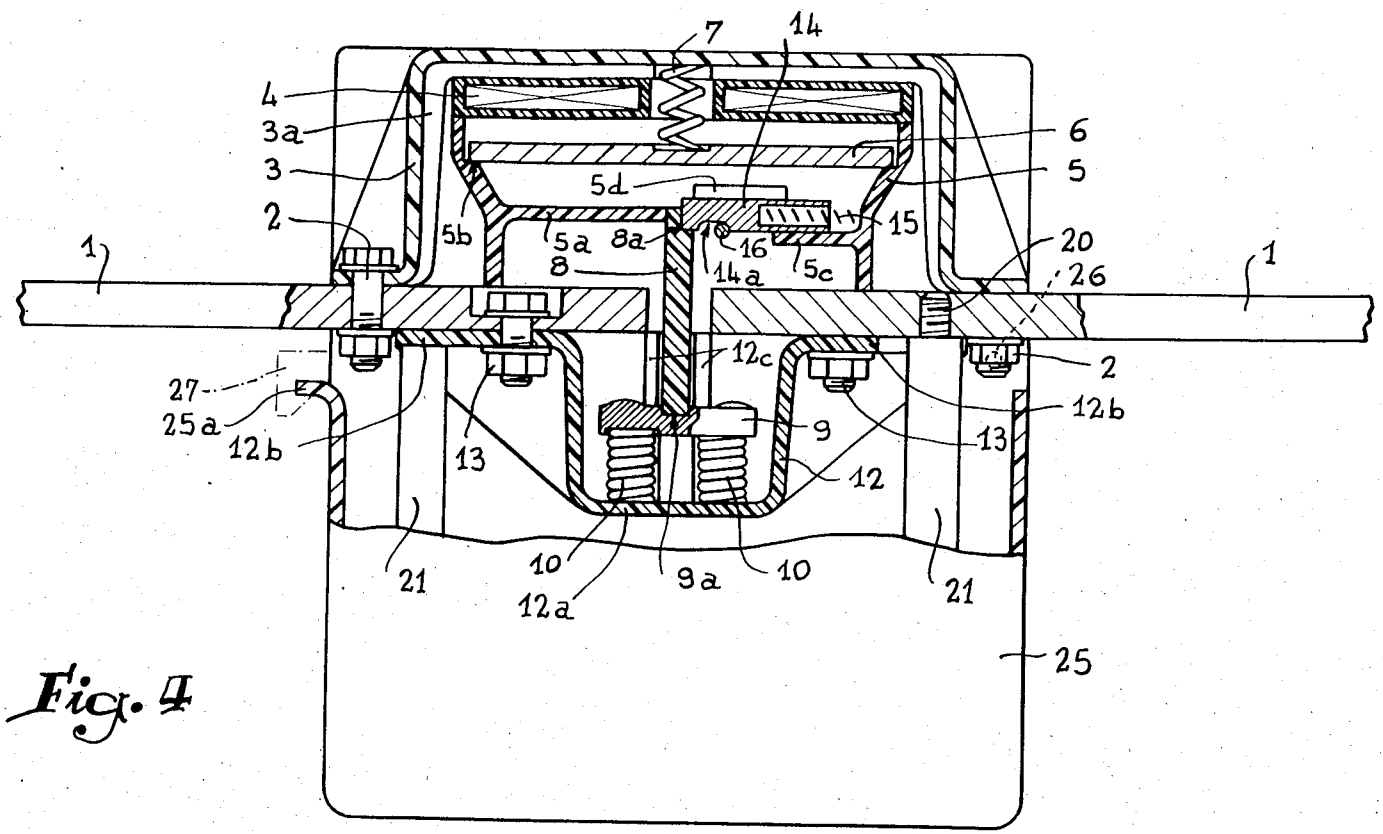
FIG. 4 is a view similar to FIG. 1, but showing the parts in the open position of the contacts.

Starting from the position of FIG. 1 and assuming that coil 4 receives a sudden driving current pulse, the plate 8 is driven downwardly, lowering the mobile contacts 9 and it is latched by the bolt 14 entering its notch 8*a* (position shown in FIG. 4). When it is desired to close the circuit again, it suffices to rotate the knob 19 in the desired direction to displace rod 16 towards the right in FIG. 1. This rod retracts bolt 14 against spring 15 and thus disengages plate 8 which rises under the effect of springs 10.

In each fixed contact bar 1 is screwed a vertical rod 20 which extends downwardly through a spacer tube 21, its lower end receiving a nut 22 which makes it possible to tighten against the spacer tube 21 one of the two flat blades 23 of a fuse cartridge 24, which is thus in shunt across the system of mobile contacts 9. As shown, rods 20 and spacer tubes 21 are long enough for the cartridge to be easily housed beneath the lower box 12.

Finally, an insulating lower cover 25 is provided, to close the cartridge. This cover, made of insulating material, is articulated on the edge of the box 12 via a pin 26. Its end opposite this pin comprises an edge 25*a* which is engaged in an appropriate retaining piece very schematically indicated in chain-dotted lines at 27.

The fuse which has just been described is totally enclosed and there is therefore no danger. However, it remains perfectly accessible, particularly for changing the cartridge after cut-off. Because of the insulating plate 8 which is inserted between the fixed contact bars 1 at the instant of opening, any risk of direct starting of arcs between the contact bars is eliminated and furthermore these contact bars 1 may be extremely close to one another, this reducing the dimensions and mass of the mobile contacts 9, thus accelerating operation.

It will further be noted that, by reason of the stop shoulder 5*b*, the kinetic energy of the mobile disc 6 is absorbed by the shock against the shoulder in question, which may be very broadly dimensioned, this dispensing with having to provide buffers, dampers or the like to limit the stroke of the mobile contacts 9, the springs 10 proving, in practice, to be largely sufficient for this purpose. Tests have shown that this arrangement avoided any operational defect of the apparatus due to untimely bounce of the mobile contact-holder plate.

What is claimed is:

1. An electro-mechanical circuit breaker having improved structure, the breaker being of the type having opposed fixed contacts spaced apart across a gap and having an insulating plate guided in a housing for reciprocation within the gap, the plate being spring-urged from a open position to a closed position and the plate carrying mobile contacts which in the closed position connect said fixed contacts together and which in the open position are spaced therefrom, and the breaker having a conductive disc in the housing disposed normal to the plate and having a coil in the housing disposed adjacent to the conductive disc on the opposite side thereof from the insulating plate and operative when the coil is energized to repel the conductive disc against the plate and drive it from its closed position toward a fully open position, and the breaker having a fuse cartridge connected in shunt with the fixed contacts and operative to melt after a brief delay when the contacts are driven open, the improvements comprising:

(a) a latch bolt supported in the housing and spring-urged toward the insulating plate, and the plate having a latching notch therein disposed to lie opposite the latch bolt when the plate is in fully open position; and (b) the housing retaining the conductive disc between the coil and the insulating plate and normal to the plate and having a shoulder disposed to stop motion of the disc after it has driven the plate partway toward its fully open position, the kinetc energy of the insulating plate carrying it the rest of the way to latch with the bolt in fully open position.

2. The circuit breaker as claimed in claim 1, wherein the conductive disc contacts and drives one edge of the insulating plate, and the insulating plate has a second opposed edge comprising multiple teeth having notches located therebetween; multiple mobile contacts disposed in said notches, each mobile contact having a notch in both sides shaped to receive the adjacent teeth of the plate, whereby the mobile contacts are maintained normal to the insulating plate and spaced across said second edge; and spring means disposed between the housing and each mobile contact and urging the contacts into the teeth and the insulating plate toward closed position.

3. The circuit breaker as claimed in claim 2, wherein said spring means comprises two springs for each mobile contact, the springs being disposed between the housing and the associated contact and being symetrically located on opposite sides of the insulating plate; and means to positively position the springs.

4. The circuit breaker as claimed in claim 2, wherein the housing comprises upper and lower mating insulating dishes bolted to opposite sides of the fixed contacts and having an intermediate portion receiving the insulating plate which extends between the dishes and through the gap, said upper dish supporting the coil and the intermediate portion being cylindrical and receiving the conductive disc and including said shoulder disposed transversely of the insulating plate; and said lower mating dish housing the mobile contacts and spring means, which are driven further into the lower mating dish when in fully open postion.

5. The circuit breaker as claimed in claim 4, wherein said housing has interior ribs disposed to receive and guide said insulating plate for reciprocation within the gap.

6. The circuit breaker as claimed in claim 4, wherein said intermediate portion of the housing supports a partition extending transversely of the insulating plate and supporting said latch bolt thereopposite.

7. The circuit breaker as claimed in claim 1, wherein each fixed contact supports a conductive spacer extending away from the coil, and wherein said cartridge fuse has mounting blades which are secured to said conductive spacers to support the fuse between the fixed contacts.

8. The circuit breaker as claimed in claim 7, wherein the housing further includes a cover hingedly connected thereto, and when closed covering said cartridge fuse and conductive spacers.

* * * * *